US008267230B2

(12) United States Patent
Johnson

(10) Patent No.: US 8,267,230 B2
(45) Date of Patent: Sep. 18, 2012

(54) TRAVELING BAG PROTECTOR

(76) Inventor: Sheila E. Johnson, Houston, TX (US)

( * ) Notice: Subject to any disclaimer, the term of this patent is extended or adjusted under 35 U.S.C. 154(b) by 267 days.

(21) Appl. No.: 11/321,743

(22) Filed: Dec. 29, 2005

(65) Prior Publication Data

US 2006/0175171 A1 Aug. 10, 2006

Related U.S. Application Data

(63) Continuation-in-part of application No. 10/657,832, filed on Sep. 9, 2003, now abandoned.

(51) Int. Cl.
*A45C 13/00* (2006.01)
*A45C 13/30* (2006.01)
*A45C 5/14* (2006.01)

(52) U.S. Cl. ..... 190/26; 190/37; 150/105; 150/154; 206/523

(58) Field of Classification Search ..... 150/103, 150/105, 154, 901; 190/26, 37, 100; 206/523, 206/315.4
See application file for complete search history.

(56) References Cited

U.S. PATENT DOCUMENTS

| | | | | | |
|---|---|---|---|---|---|
| 796,286 | A | * | 8/1905 | Botteese | 190/26 |
| 1,526,839 | A | * | 2/1925 | Dempsey | 190/26 |
| 2,432,365 | A | * | 12/1947 | Allen | 190/115 |
| 2,487,596 | A | * | 11/1949 | Sackstein | 190/26 |
| 2,532,154 | A | * | 11/1950 | Duskin | 190/26 |
| 2,575,191 | A | * | 11/1951 | Seipp | 383/97 |
| 2,627,887 | A | * | 2/1953 | Becker | 206/14 |
| 2,647,595 | A | * | 8/1953 | Meyers | 190/26 |
| 4,375,828 | A | * | 3/1983 | Biddison | 383/41 |
| 4,569,082 | A | * | 2/1986 | Ainsworth et al. | 383/3 |
| 4,846,340 | A | * | 7/1989 | Walther | 206/14 |
| 4,953,674 | A | * | 9/1990 | Landes | 190/108 |
| 5,005,679 | A | * | 4/1991 | Hjelle | 190/110 |
| 5,586,345 | A | * | 12/1996 | Nielsen et al. | 5/99.1 |
| 5,839,577 | A | * | 11/1998 | Friedler | 206/315.1 |
| 6,637,562 | B2 | * | 10/2003 | Oh | 190/26 |

FOREIGN PATENT DOCUMENTS

| | | | |
|---|---|---|---|
| GB | 18302 | * | 0/1913 |
| GB | 2147497 A | * | 5/1985 |
| GB | 2167656 A | * | 6/1986 |
| GB | 2253781 A | * | 9/1992 |

* cited by examiner

*Primary Examiner* — Sue Weaver
(74) *Attorney, Agent, or Firm* — Delphine James

(57) ABSTRACT

A protective covering for a traveling bag comprising a housing having a cavity dimensioned to encompass the covered traveling bag is provided. The housing has substantially an equivalent shape to the covered traveling bag. The housing further comprises of an upper section, lower section, front section, back section, a first side section and opposite second side section. Each section can be a panel with a polygonal shape. A slot disposed within the upper panel such that it is aligned over the handle of the covered traveling bag and is dimensioned to hold the handle of the covered bag in a telescoped position. The lower panel further comprises at least one opening in the dimensioned to accommodate the bottom of the covered traveling bag. The protective covering further comprises an inlet for insertion and removal of the traveling bag into the cavity of the housing.

21 Claims, 24 Drawing Sheets

TRAVELING BAG PROTECTOR

This patent is a continuation in part of application Ser. No. 10/657,832, filed Sep. 9, 2003 now abandoned

BACKGROUND OF THE INVENTION

The present invention relates to luggage utilized to travel long distances. More particularly the present invention relates to protective coverings for luggage utilized to travel long distances. In the prior art there are several types of luggage utilized for travel, for example, U.S. Pat. No. 6,431,580 B1 to Kady, shows an improvement on prior art for a collapsible wheeled caddy. The wheeled caddy, having multiple purposes, has a front and back panel, vertically hinged side panels, a hinged bottom panel and retractable handles within the back panel, U.S. Pat. No. 6,109,627 to Be, shows a bowling bag carrier, carrying two or three bags loaded with a plurality of bowling balls and allowing a user to easily receive or remove bowling balls into or from the bags. The wheeled bag may lie on its side or stand on its bottom. U.S. Pat. No. 5,074,571 to Reese, shows an apparatus for transporting, storing and carrying a plurality of bowling balls, bowling accessories and equipment, includes a housing having vertically stacked interior compartments for storing bowling balls and U.S. Pat. No. 5,431,428 to Marchwiak, et al. shows a carrying case assembly is provided with a case defining an enclosed interior, and a collapsible handle assembly disposed within the case. The handle assembly includes a push button which allows the handle to collapse conjunctions with the extended handle, the case may be transported as if it were a wheeled cart.

What is needed is a covering to protect a passenger's luggage while traveling on public transportation such as airplanes, buses, and trains.

SUMMARY

The present invention provides a protective covering for a traveling bag. The protective covering further comprises a housing having an upper, lower, front, back, a first side and opposite second side sections. Each section can be a panel. The shape of the protective covering is equivalent to the shape of the traveling bag and the housing has a cavity dimensioned to encompass the traveling bag. The protective covering further includes a slot within the upper panel that is aligned over the handle of the traveling bag and is dimensioned to accommodate the handle of the traveling bag in a telescoped position.

The present invention further comprises an inner layer cushioning means abutting and is securely attached to and spans the interior wall of the front panel. The present invention has a releasable fastening means strategically placed on a selected panel for easy insertion and removal of the travel bag into the cavity of the housing of the protective covering. In some embodiments the releasable fastening means can be affixed to the peripheral edges of upper panel or the back panel. In other embodiments the releasable fastening means can be vertically disposed or horizontally disposed across the back panel. The bottom panel can have at least one opening to accommodate the wheels and/or stand of the travel bag.

Various embodiments of the bottom panel of the present invention for supporting various bottom types of traveling bags are disclosed. In some embodiments the bottom panel has a single rectangular opening and in other embodiments the bottom panel has a single elongated opening having an oval opening aligned above or below an integrated rectangular shaped opening.

DRAWINGS

DETAILED SPECIFICATION

Figure 1:
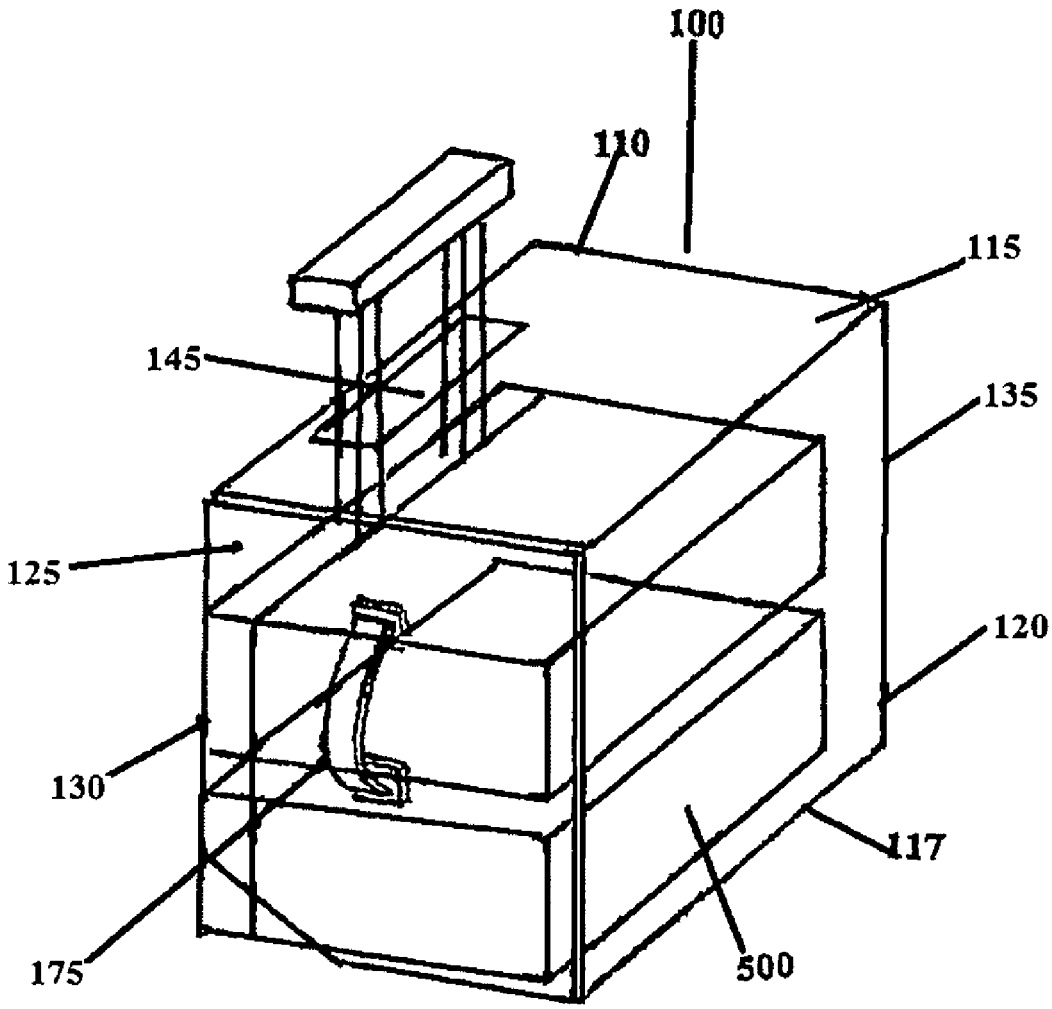
FIG. 1 is a side perspective view of the present invention, a protective covering for a traveling bag.

Referring to FIG. 1, there is shown a perspective view of the present invention, a protective covering (100) for a traveling bag (500). The protective covering (100) for the traveling bag (500) includes a housing (110) defined by an upper section (115), a bottom section (117), a front section (120), a back section (125), a first side section (130), and an opposite side section (135).

In the illustrated embodiment, housing (110) has a cavity dimensioned to encompass the covered traveling bag (500). Each section of the housing (110) has substantially an equivalent shape to each section of the traveling bag (500). In this kind of embodiment, each section of the housing (110) has a panel with a polygonal shape.

Figure 24:
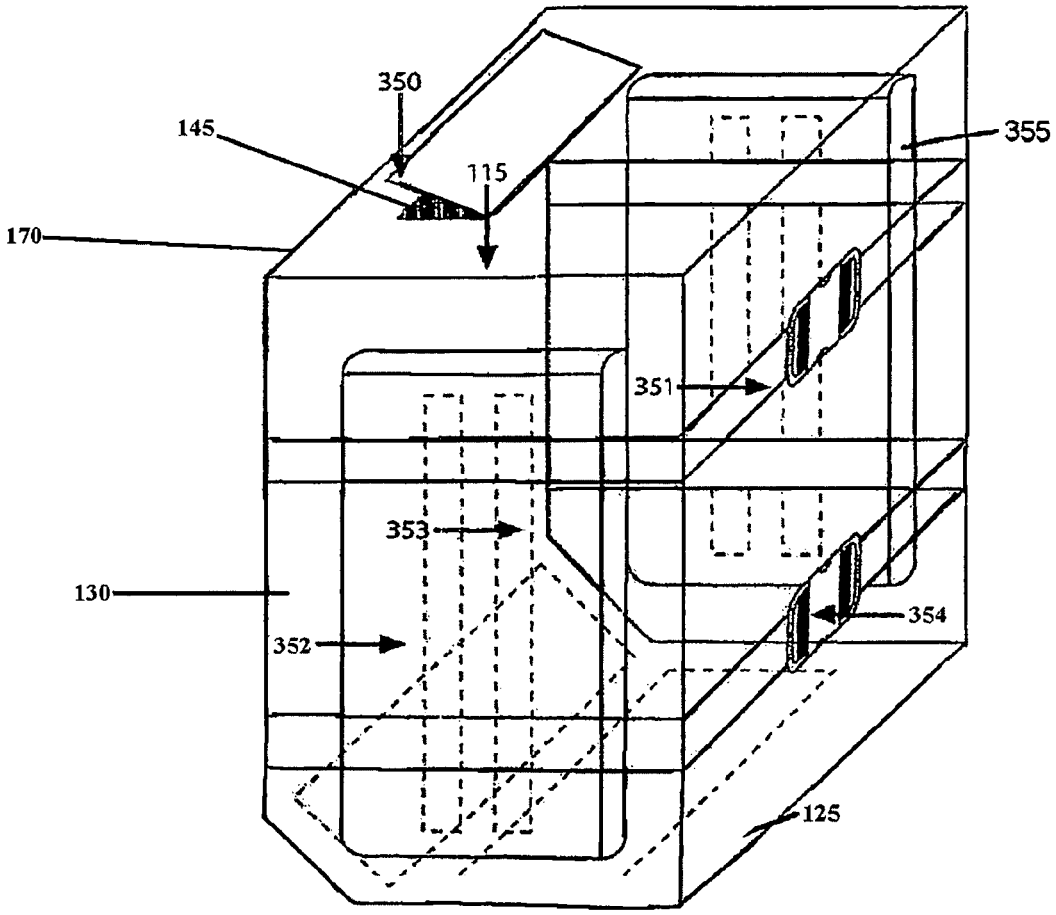
FIG. 24 illustrates an alternative embodiment utilizing internal cushioning and a flap.

Protective covering (100) further includes slot (145) within the upper panel (115) aligned over the handle of the traveling bag and dimensioned to accommodate the handle of covered traveling bag (500) in a telescoped position as shown in FIG. 1. The protective covering (100) can be made of strong synthetic polyester or another suitable material in which luggage is made of. Additionally, the bottom panel (117) can be made of a sturdy rigid material such as plastic or another suitable material. As shown in FIG. 24, flap 350 can be added to cover the opening in slot 145. Flap 350 is specifically dimensioned and contoured to cover the dimensions of the opening in slot 145. As depicted one side of the flap is aligned adjacent to a side edge of slot 145 and is securely affixed thereto.

Figure 2:
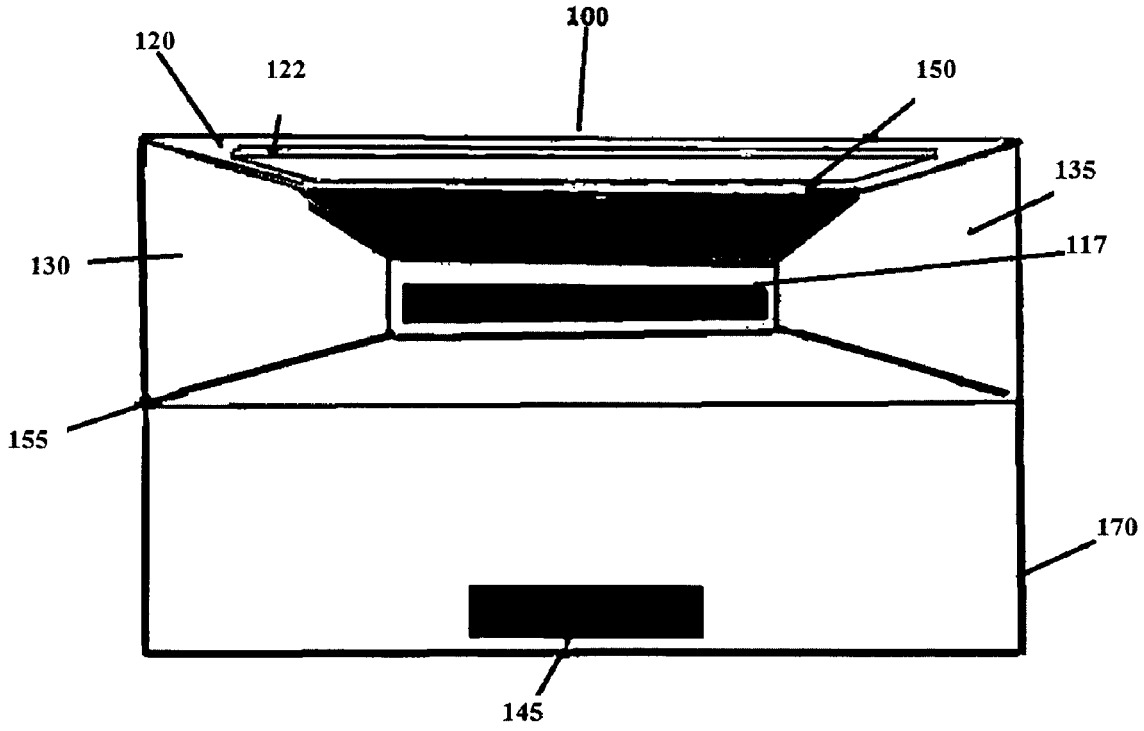
FIG. 2 is a top plan internal view of the present invention.

Referring to FIG. 2, there is shown, a top plan view of the present invention. In the illustrated embodiment, the present invention further includes at least one opening within the bottom panel (117) to accommodate the wheels and/or the stand of the covered traveling bag (500). As illustrated in this particular embodiment, the bottom panel (117) has two openings. First opening (150) is dimensioned to accommodate the stand of the covered bag. Second opening (155) is dimensioned to accommodate the wheels of the covered bag.

The illustrated embodiment further comprises an inner layer cushioning means (122) abutting and securely attached to the interior wall of the front panel (120). Additionally, the inner layer cushioning means (122) spans the interior wall of the front panel (120). Cushioning means (122) can be made of Styrofoam, sponge, or another suitable means. Additionally, the inner layer cushioning means 122 can be removably attached utilizing suitable fastening means such as VELCRO. In alternative embodiments, cushioning means (122) can partially spans the interior wall of front panel (120). An inlet means (170) provides access for insertion and removal of the traveling bag into the cavity of the housing (110).

Referring to FIG. 24, there is shown an alternative embodiment of the present invention. In this embodiment the present invention further comprises a second inner cushioning means 352 and a third inner cushioning means 355. The second inner cushioning means 352 abuts and is removably attached utilizing suitable fastening means 353 such as VELCRO. The third inner cushioning means 355 abuts and is removably attached utilizing suitable fastening means 353 such as VELCRO. The second inner cushioning means spans the interior wall of first side section 130. The third inner cushioning means spans the interior wall of opposite side section 135. Both the second and third inner cushioning means can partially span the interior wall. Additionally, at least one pair of cooperative fastening straps 351 can be internally and securely affixed within the internal cavity. Cooperative fastening straps 351 are utilized to secure the traveling bag therein. A second pair of cooperative fastening straps 354 can be utilized to further secure the traveling bag within the interior cavity.

As shown in FIG. 1, the illustrated embodiment further includes at least one handle means (175) securely attached to the exterior of the first side panel (130) of protective covering (100). Handle means (175) is aligned parallel to the slot (145) in the upper panel (115). Additionally, handle means (175) can attach to the exterior of the opposite second side panel (135), the front panel (120), the back panel (125) or the upper panel (115). In alternative embodiments, a second handle means (175) can be attached to the opposite second side panel (135) or any of the additional panels of the protective covering (100).

Figure 3:
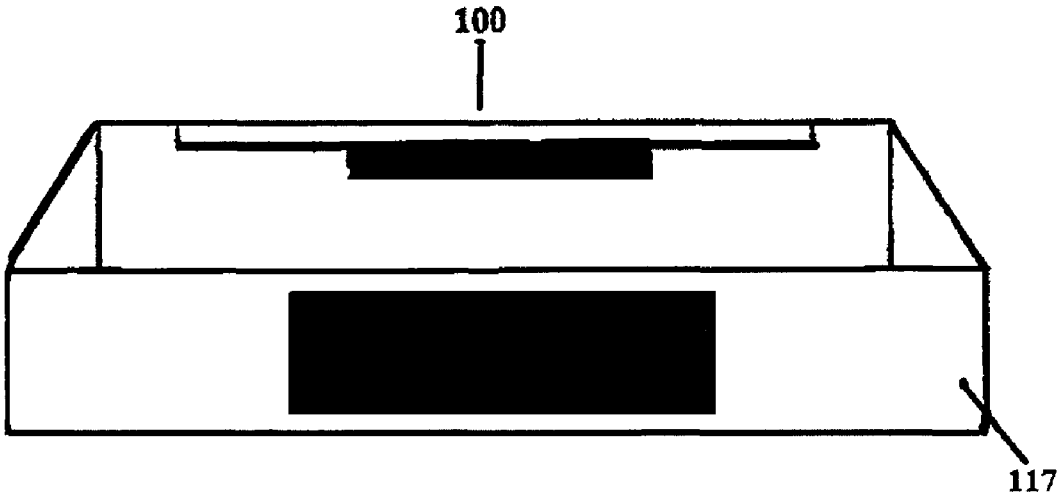
FIG. 3 illustrates a rear view of the bottom panel of the protective covering.
Figure 4:
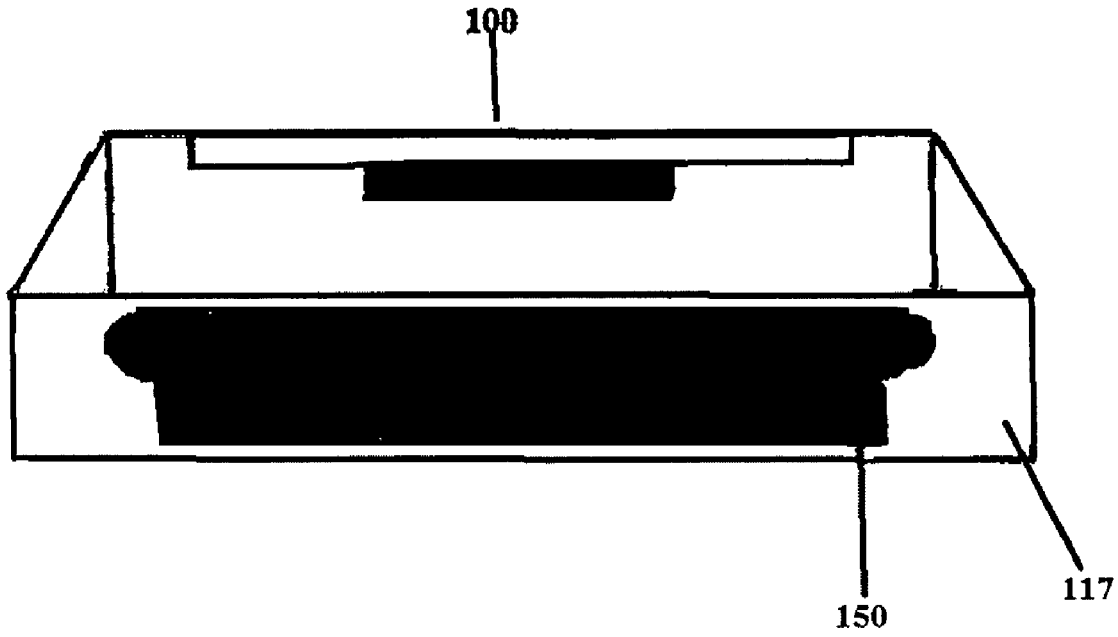
FIG. 4 is a rear view of the bottom panel of the protective covering illustrating an alternative embodiment.
Figure 5:
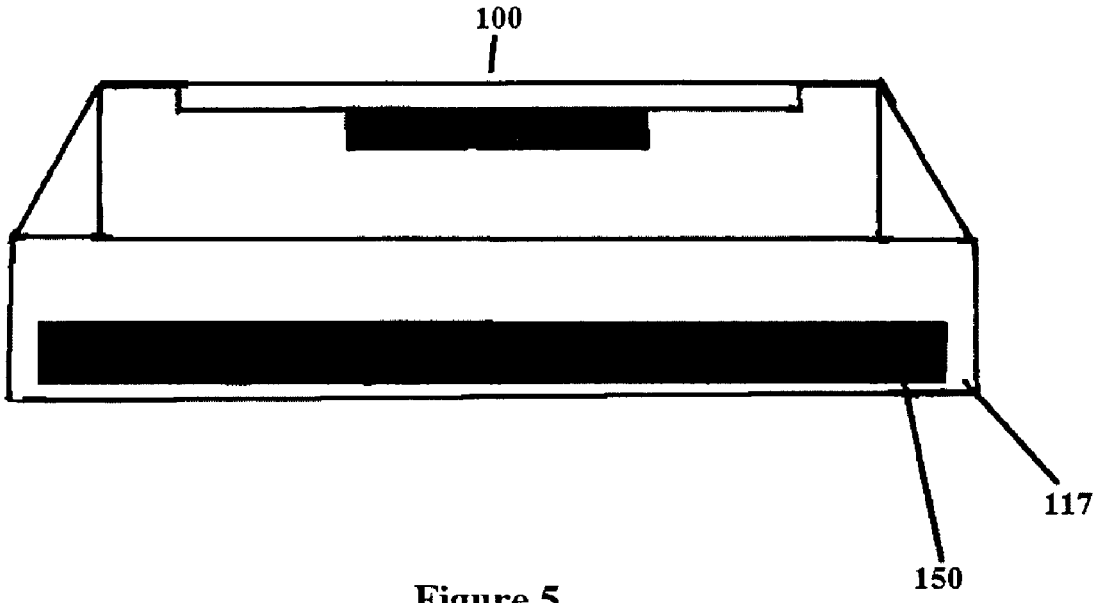
FIG. 5 is a rear view of the bottom panel of the protective covering illustrating an alternative embodiment.
Figure 6:
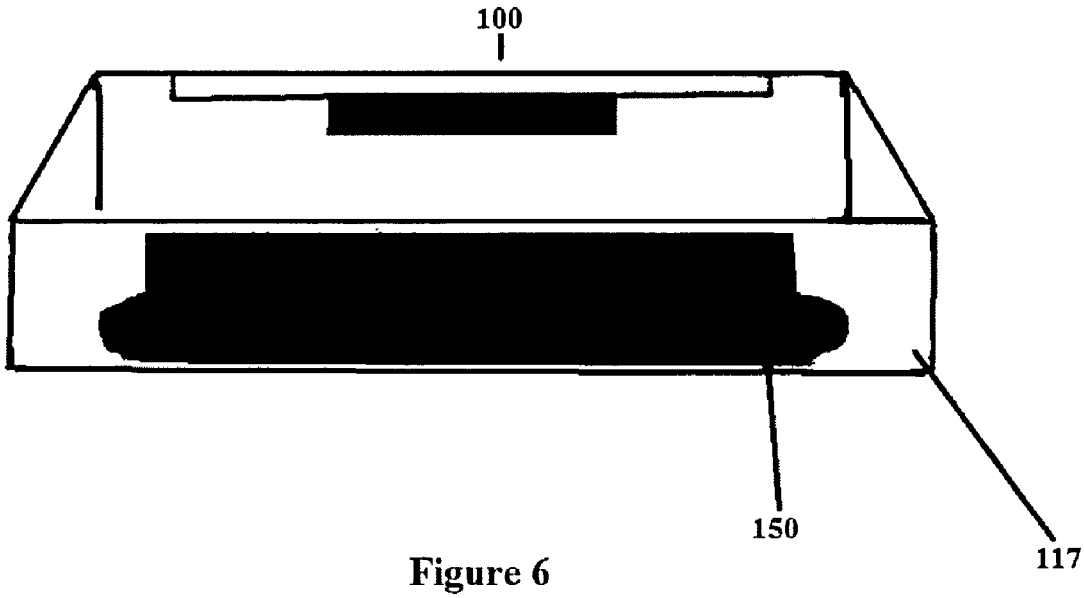
FIG. 6 is a rear view of the bottom panel of the protective covering illustrating an alternative embodiment.
Figure 7:
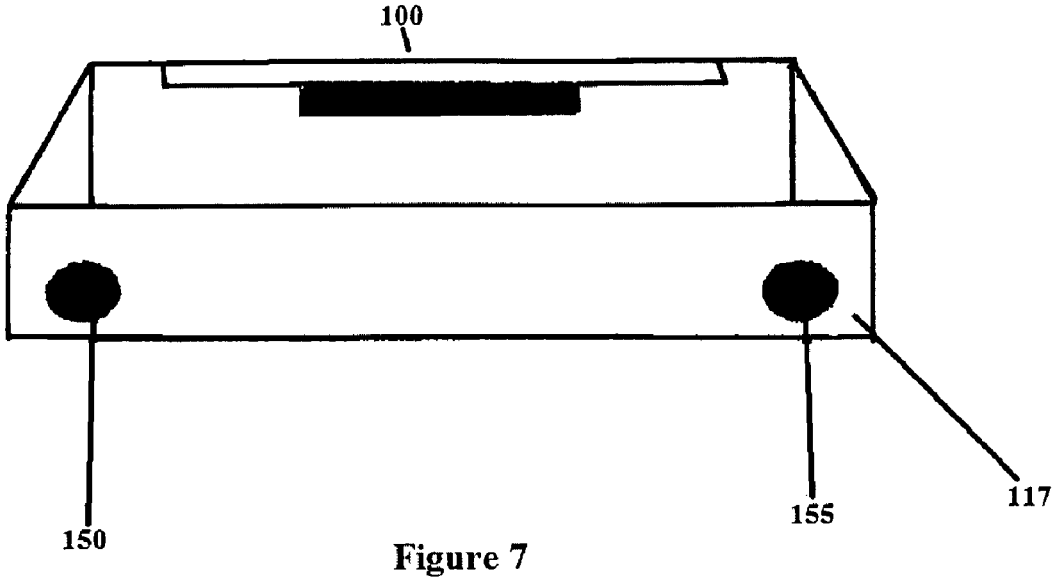
FIG. 7 is a rear view of the bottom panel of the protective covering illustrating an alternative embodiment.

Referring to FIGS. 3-7, there is shown various alternative embodiments of the bottom panel (117) of the present invention for supporting various types of traveling bags. Referring to FIG. 3, there is shown a rear view of the bottom panel (117) having a single rectangular opening centered in bottom panel (117). Referring to FIG. 4, there is shown a rear view of the bottom panel (117) having a single elongated opening (150) centered in bottom panel (117). Elongated opening (150) comprises an oval opening aligned above and integrated into a rectangular shape opening. Referring to FIG. 5, there is shown a rear view of the bottom panel (117) having a single elongated rectangular opening centered in bottom panel (117). Referring to FIG. 6, there is shown a rear view of the bottom panel (117) having a single elongated opening (150) centered in bottom panel (117). Elongated opening (150) comprises an oval opening aligned below and integrated into a rectangular shape opening. Referring to FIG. 7, there is shown a rear view of the bottom panel (117) having two small circular openings (150, 155) spaced at opposite ends of the bottom panel (117).

Referring to FIGS. 8-23, there is shown alternative embodiments for the inlet means (170) of the present invention. Inlet means (170) in the present invention can be implemented utilizing zippers or other such compatible .releasable fastening means.

Figure 8:
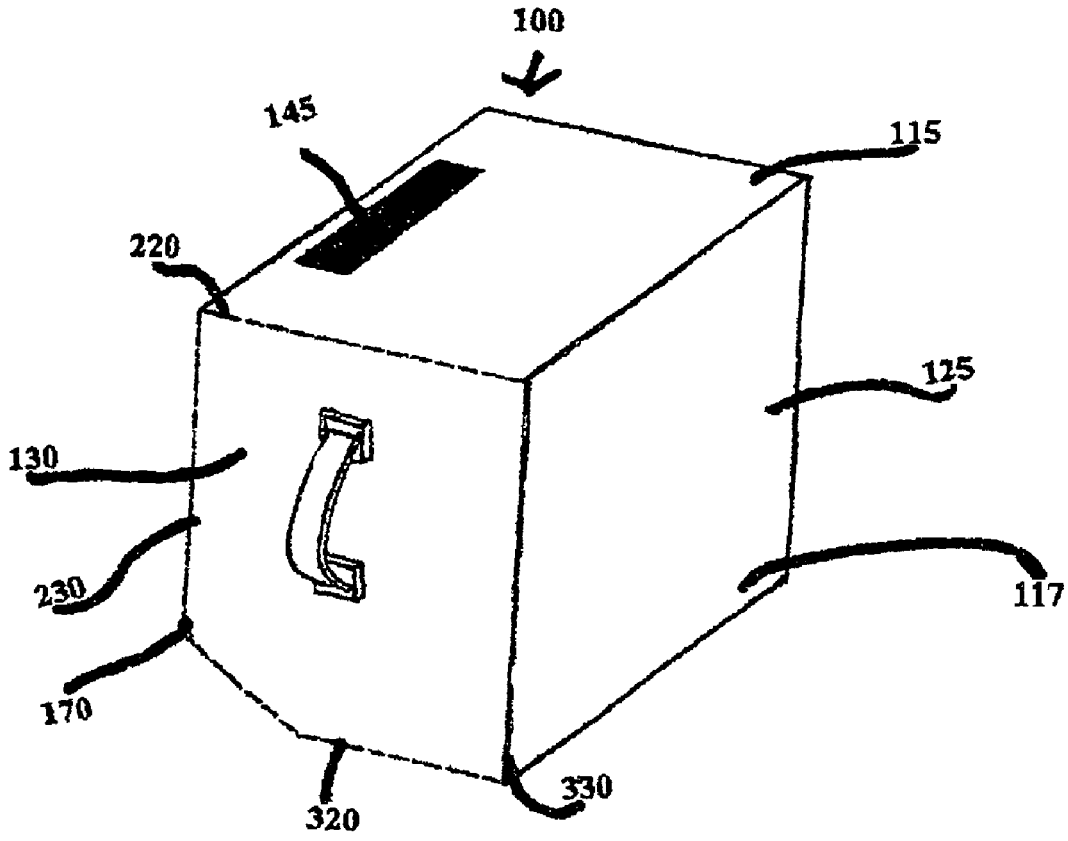
FIG. 8 illustrates a side view of the inlet means for the present invention along the side panel.
Figure 9:
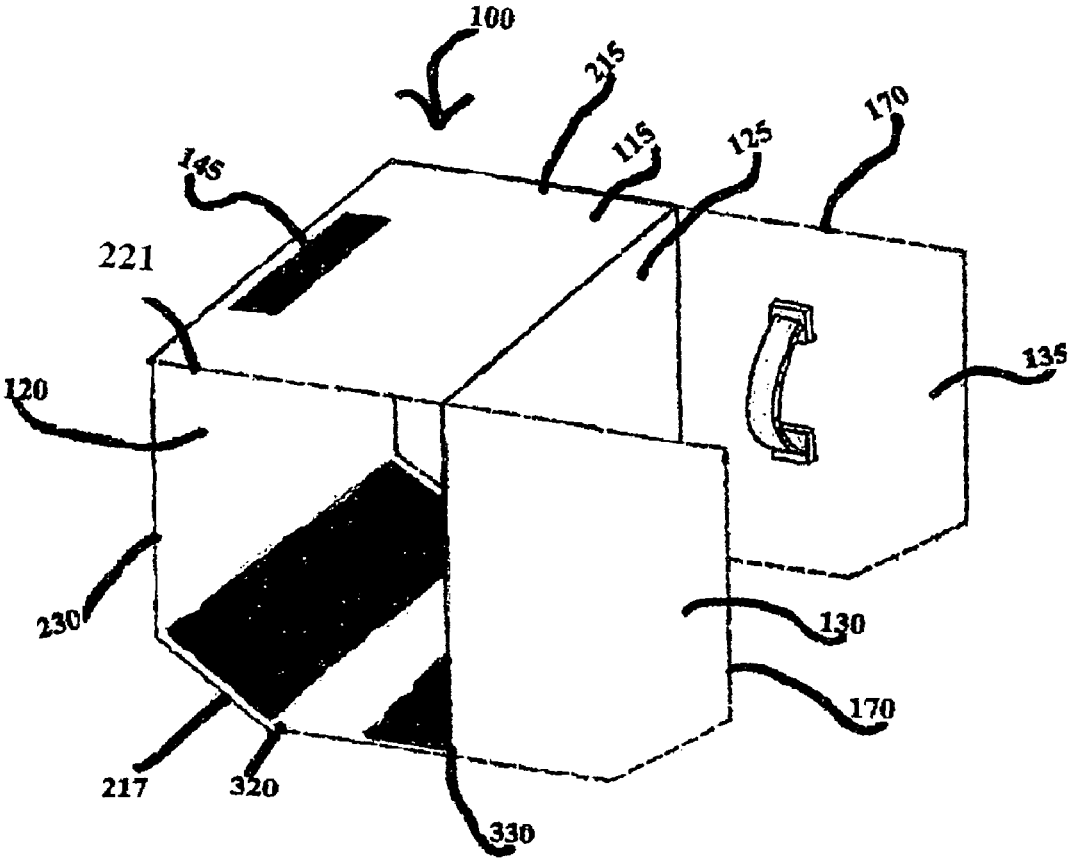
FIG. 9 is a side view of the inlet means for the present invention along the side panel in an opened position.

Referring to FIG. 8, there is shown one embodiment of how inlet means (170) is attached to the present invention. In the illustrated embodiment, first side panel (130) has a hexagonal shape. Additionally, the opposite second side panel (135) is also hexagonal as shown in FIG. 9. However, the upper panel (115), bottom panel (117), and back panel(125) each has. a rectangular shape. Side panel (130) and opposite second side panel (135) further include an upper edge (220), a lower edge (320), a first side edge (230) and an adjoined opposite second side edge (330). Releasable fastening means (170) is affixed to the upper edge (215), the lower edge (217) and the first side edge (230). As shown in FIG.9, while in an opened position side panel (13.0) can pivot backward and forward along the second opposite side edge (330) allowing the covered bag to be inserted into the housing cavity of protective covering (100). Additionally upper edge 221 is detached as shown in FIG. 9.

Figure 10:
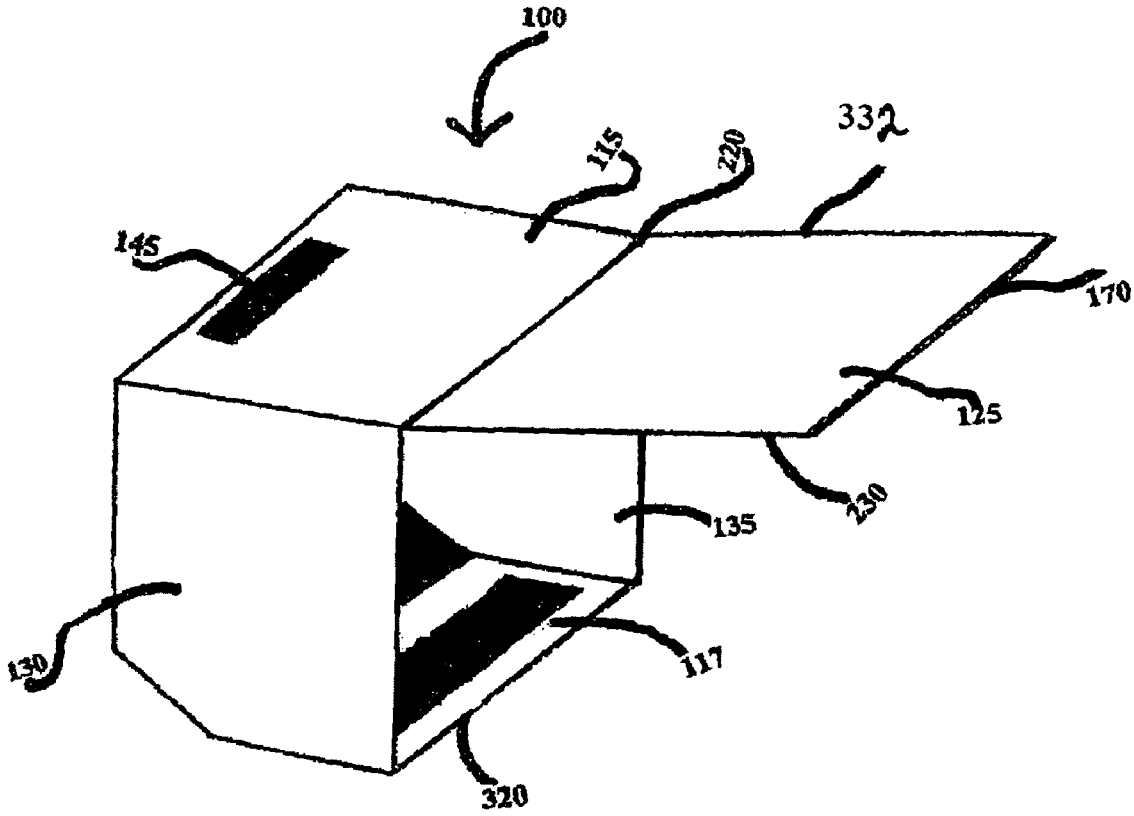
FIG. 10 illustrates a side view of the inlet means along an edge of the bottom panel.

Referring to FIG. 10, releasable fastening means (170) is affixed onto an edge of the back panel (125). In this kind of embodiment, back panel (125) further includes an adjoined upper edge (220), a releasable attached lower edge (320), a detachable. first side edge (230) and a detachable opposite second side edge (331). Releasable fastening means (170) is affixed to the lower edge (320) and can be a zipper means or another such compatible means First side edge (230) and opposite side edge (332) can be equipped with attachable and detachable means such as Velcro. As shown in FIG. 10, while-in an opened position back panel (125) pivots upward along the upper edge (220) allowing access into the housing cavity of protective covering (100).

Figure 11:
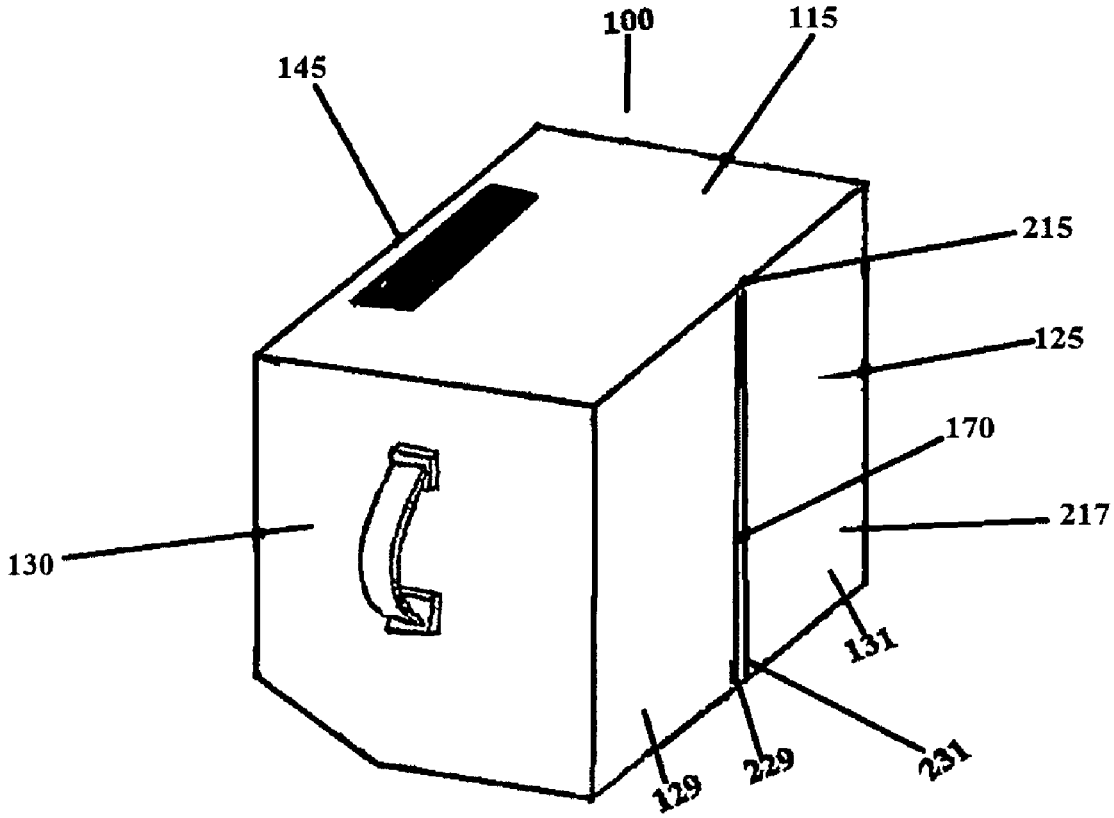
FIG. 11 illustrates a side view of the inlet means vertically disposed at an intermediate point on the back panel.
Figure 12:
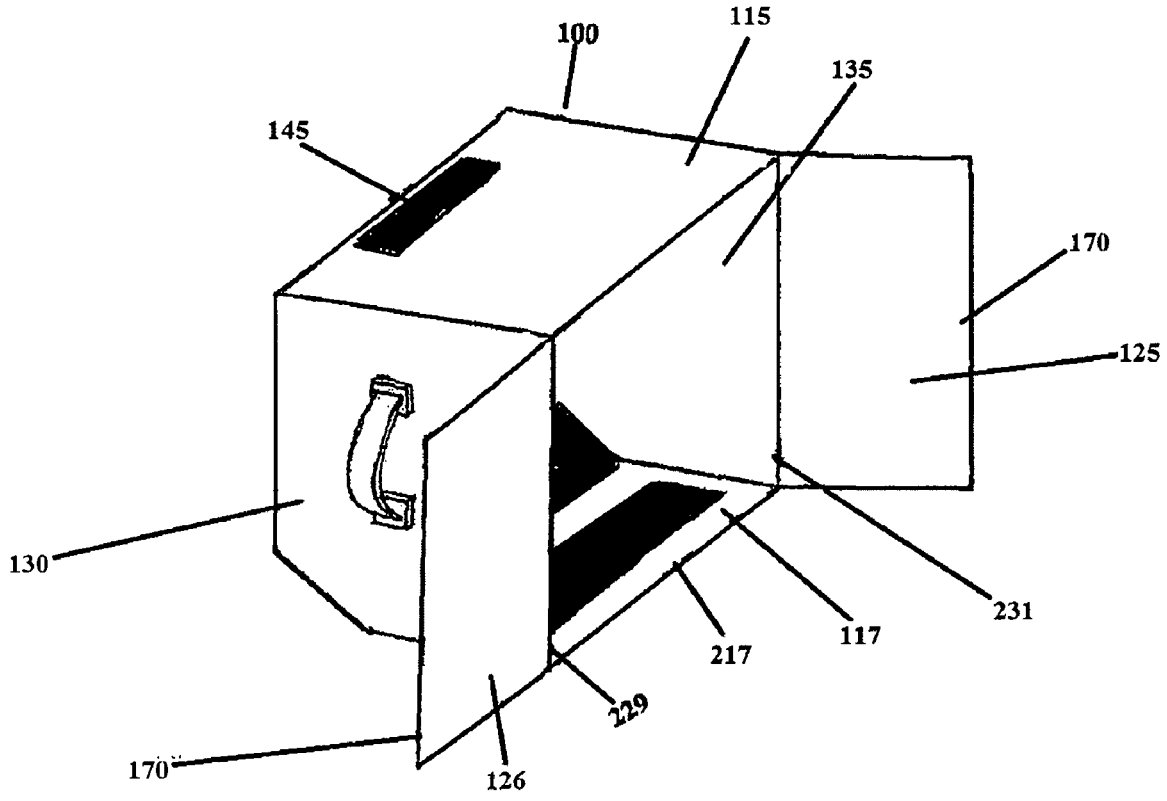
FIG. 12 illustrates the inlet means in an opened position.

Referring to FIGS. 11 and 12. releasable fastening means (170) is affixed vertically (170) across the back panel (125) at an intermediate location dividing the back panel (125) into a left section (129) and a right section (131). The back panel (125) is further defined by an adjoined left edge (229) and an adjoined right edge (231), a detached upper edge (215) and a detached lower edge (217). As shown in FIG. 12, in an opened position the left section (129) is pivoted outward along the left edge (229) and the right section (131) is pivoted outward along the right edge (231), whereby the covered bag can be inserted into and removed from the protective covering. In alternative embodiment, the upper edge (215) and the lower edge can be equipped with attachable and detachable means such as Velcro.

Figure 13:
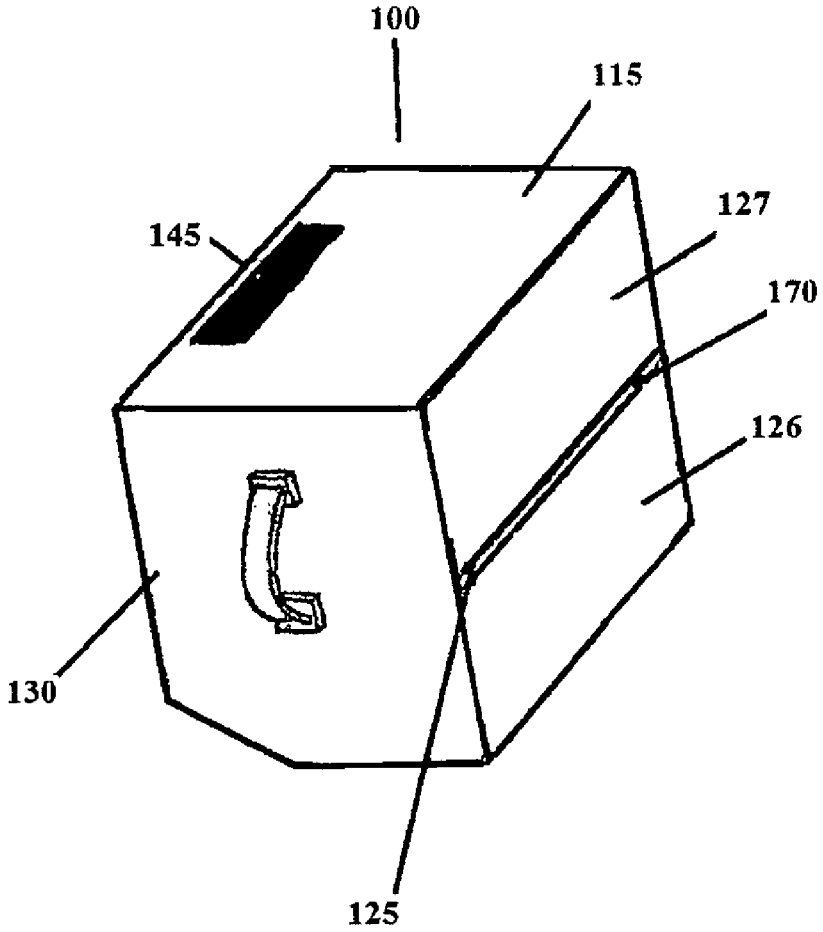
FIG. 13 illustrates a side view of the inlet means horizontally disposed upon the back panel.
Figure 14:
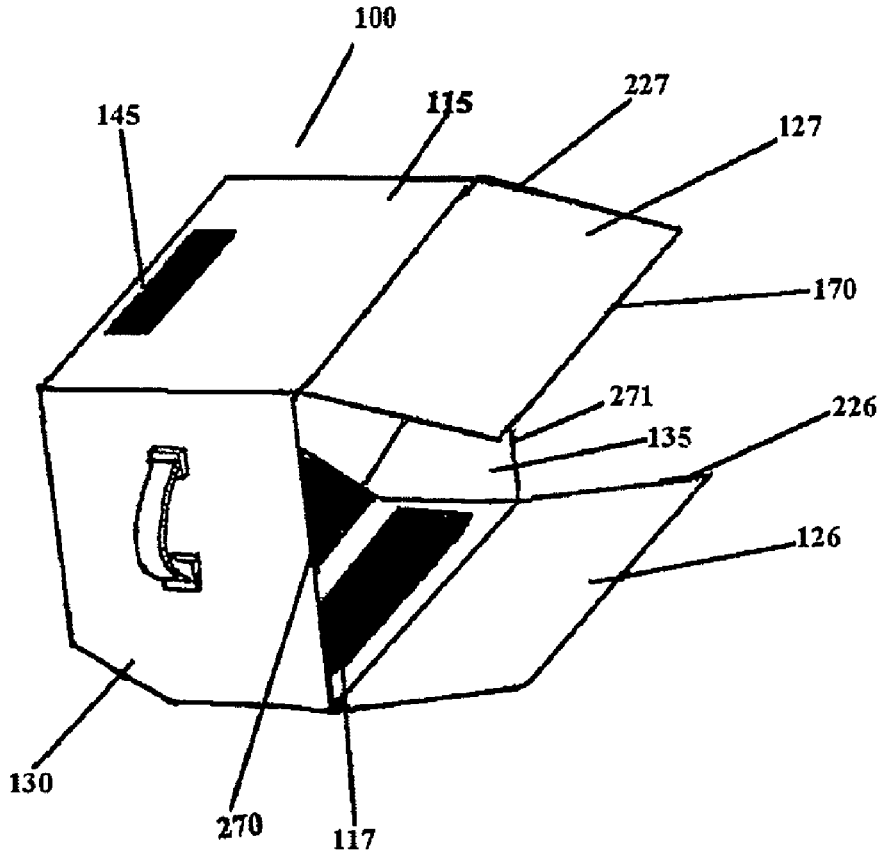
FIG. 14 illustrates the inlet means in an opened position.

Referring to FIGS. 13 and 14, releasable fastening means (170) is affixed horizontally across the back panel (125) at an intermediate location dividing the back panel (125) into an upper section (127) and a lower section (126). The back panel (125) is further defined by an adjoined upper edge (227) and an adjoined lower edge (226), a detached side edge (270), and a detached opposite side edge (271). In the illustrated embodiment shown in FIG. 14, while in an opened position (135), the upper section (127) is pivoted upward along the upper edge (227) and the lower section (126) is pivoted downward along the lower edge (226) allowing the covered bag to be inserted into and removed from the housing cavity of the protective covering (100). In alternative embodiments, protective covering (100)" side edge (271)' and opposite side edge (270) can be equipped with attachable and detachable means such as Velcro.

Figure 15:
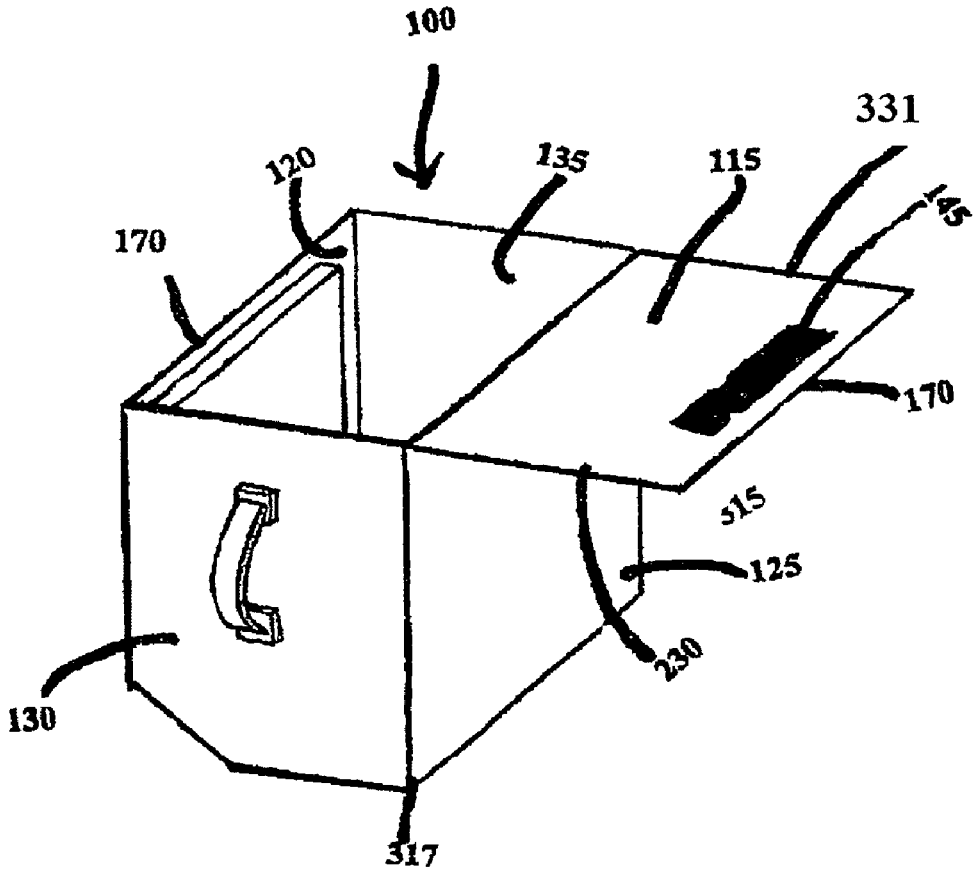
FIG. 15 illustrates a top view of the inlet means disposed along the edges of the upper panel in an open position of upper panel with releasable means.
Figure 16:
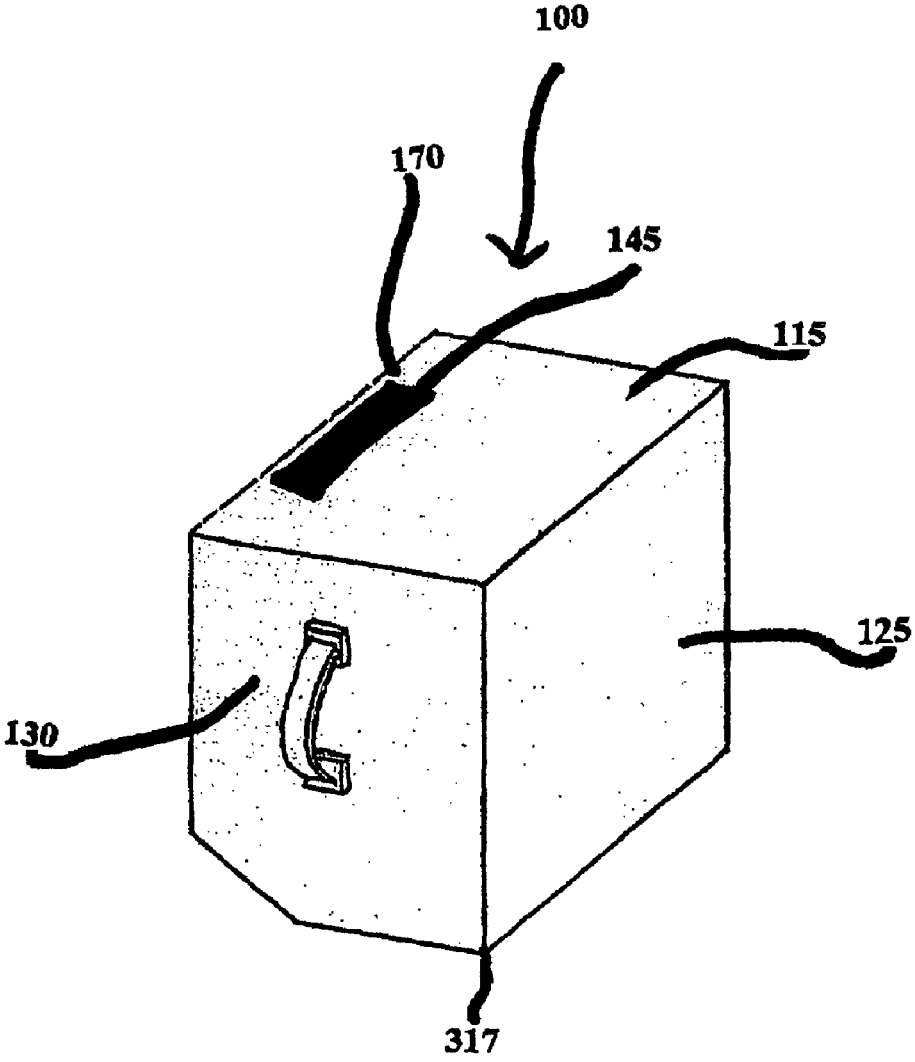
FIG. 16 illustrates a top view of the inlet means disposed along the edges of the upper panel in a closed position of upper panel with releasable means.

Referring to FIGS. 15 and 16, releasable fastening means (170) is affixed to the peripheral edges of upper panel (115). Upper panel (115) further includes an adjoined lower edge (317), a detached upper edge (315), a detached first side edge (230), and a detached opposite second side edge (330). Releasable fastening means (170) is affixed along the upper edge (315), the first side edge (230) and the opposite second side edge (330). As shown in FIG. 15, while in an opened position the upper panel (115) would pivot forward and backward upon the lower edge (317).

Figure 17:
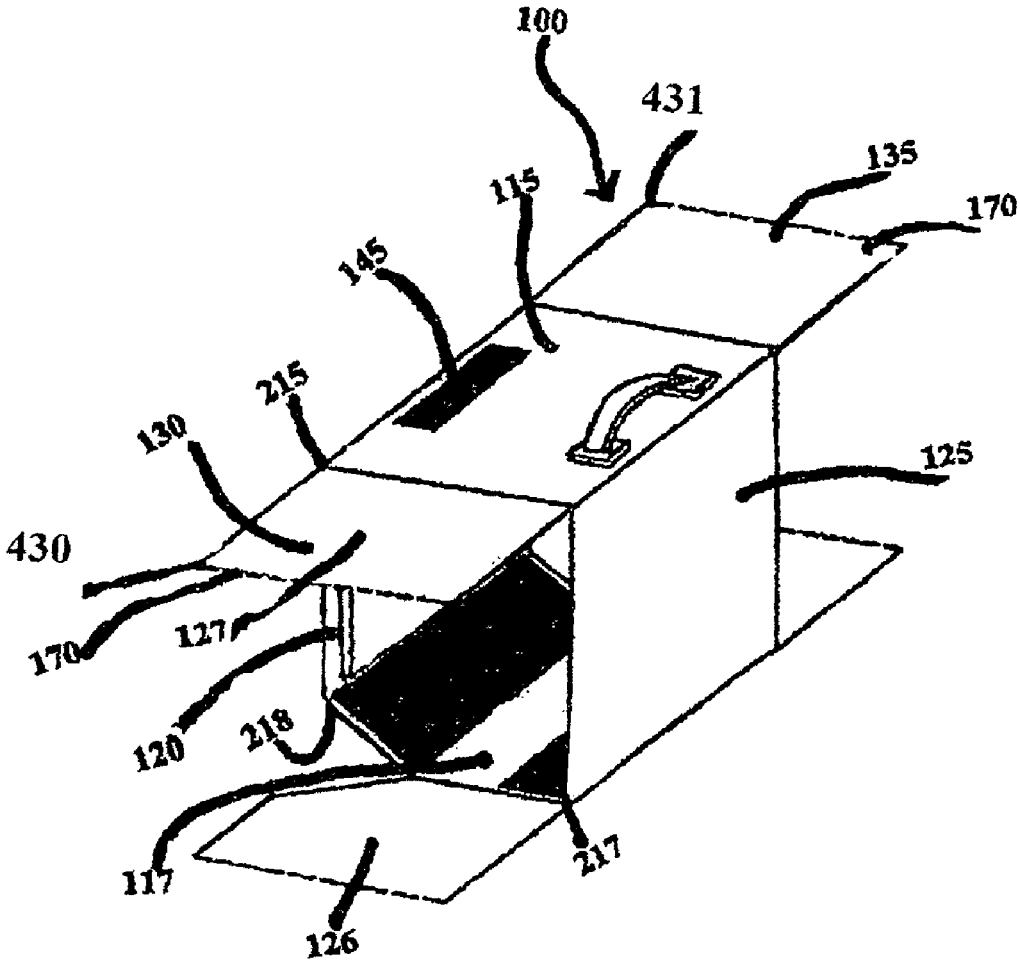
FIG. 17 illustrates a top view of the inlet means disposed horizontally across each side panel.

Referring to FIG. 17, releasable fastening means (170) is affixed horizontally (170) across each side panel (130, 135) at an intermediate location dividing each side panel (130,135) into an upper section (127) and a lower section (126). Each side panel (130,135) is further defined by an adjoined upper edge (215), an adjoined lower edge (217), a detached side edge (330) and a detached opposite side edge (331). As shown in FIG. 17, while in an opened position, the upper section (127) pivots upward along the lower edge (217) and the lower section (126) pivots downward along the lower edge (218) allowing the traveling bag to be inserted into and removed from the housing cavity of the protective covering (100). In alternative embodiments, the upper edge (215) and the lower edge (217) can be equipped with attachable and detachable means such as Velcro.

Figure 18:
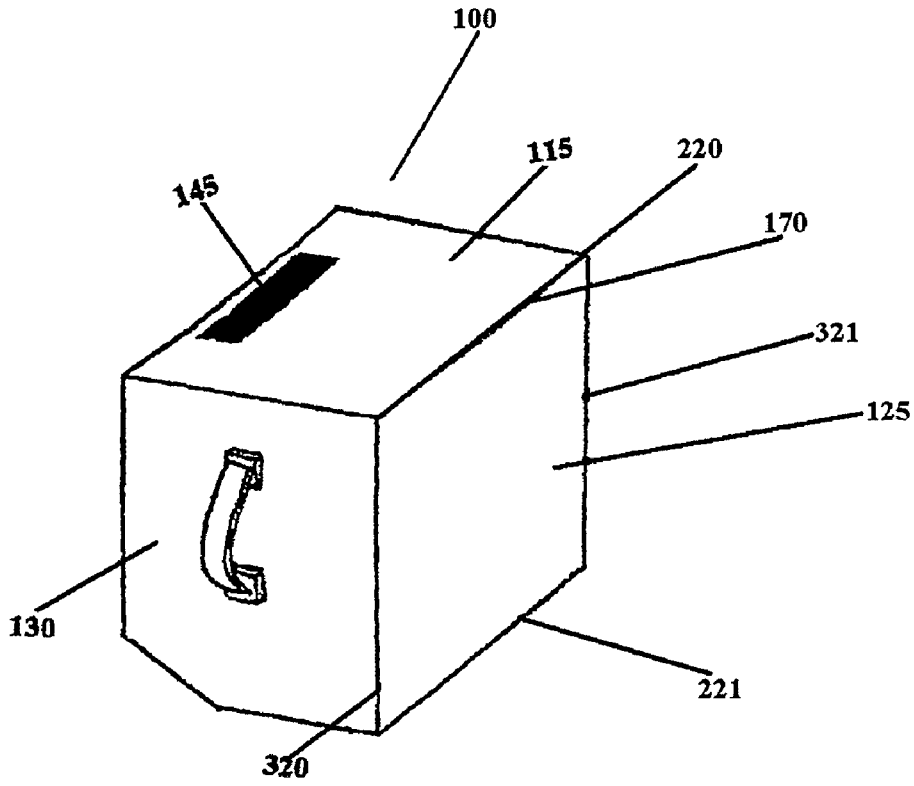
FIG. 18 is a top view of the inlet means along the upper edges of the back panel.
Figure 19:
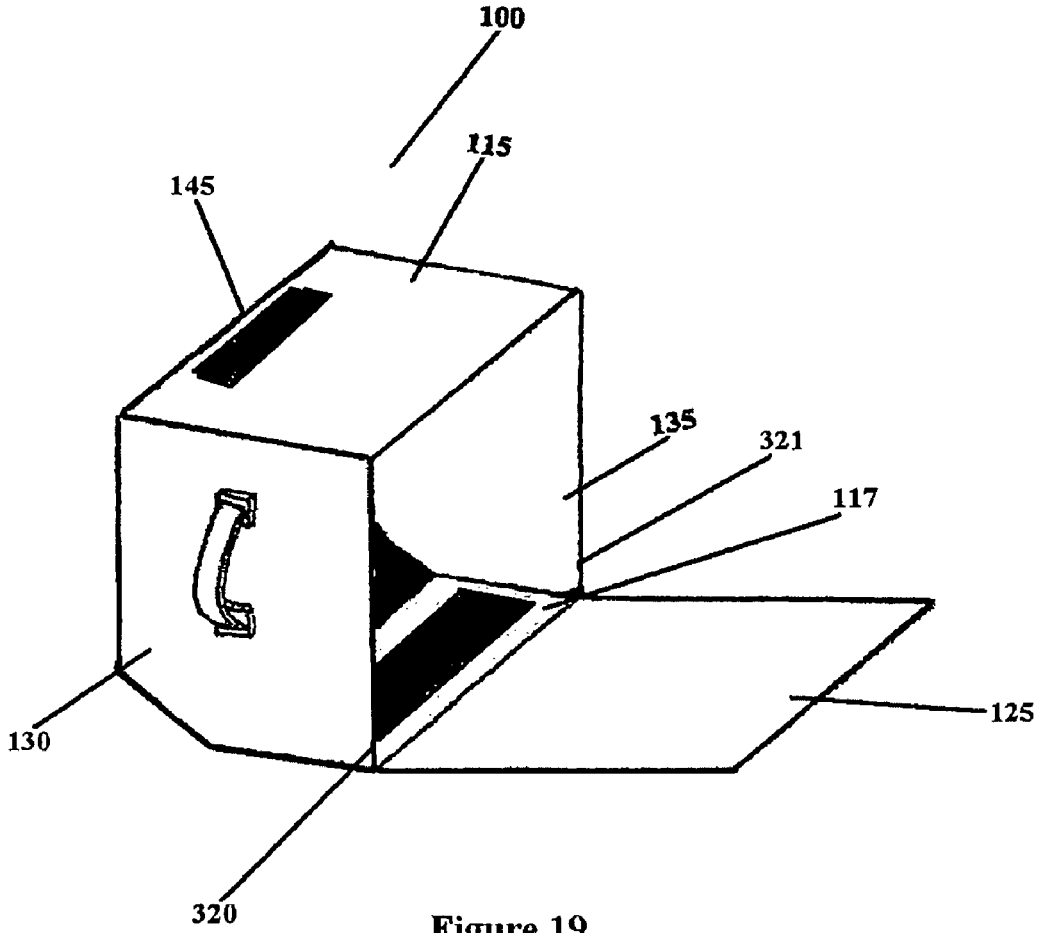
FIG. 19 is a top view of the inlet means along the upper edges of the back panel in an opened position.

Referring to FIGS. 18 and 19, releasable fastening means (170) is affixed to the peripheral edges of the back panel (125). Back panel (125) is further defined by an upper edge (220), an adjoined lower edge (221), a first side edge (320) and an opposite second side edge (321). In this embodiment, releasable fastening means (170) is affixed to the upper edge (221), the first side edge (320) and the opposite second side edge (321). As shown in FIG. 19, while in an opened position the back panel (125) can pivot upward and downward along the lower edge (221) such that the traveling bag can be inserted into and removed from the housing cavity of the protective covering (100).

Figure 20:
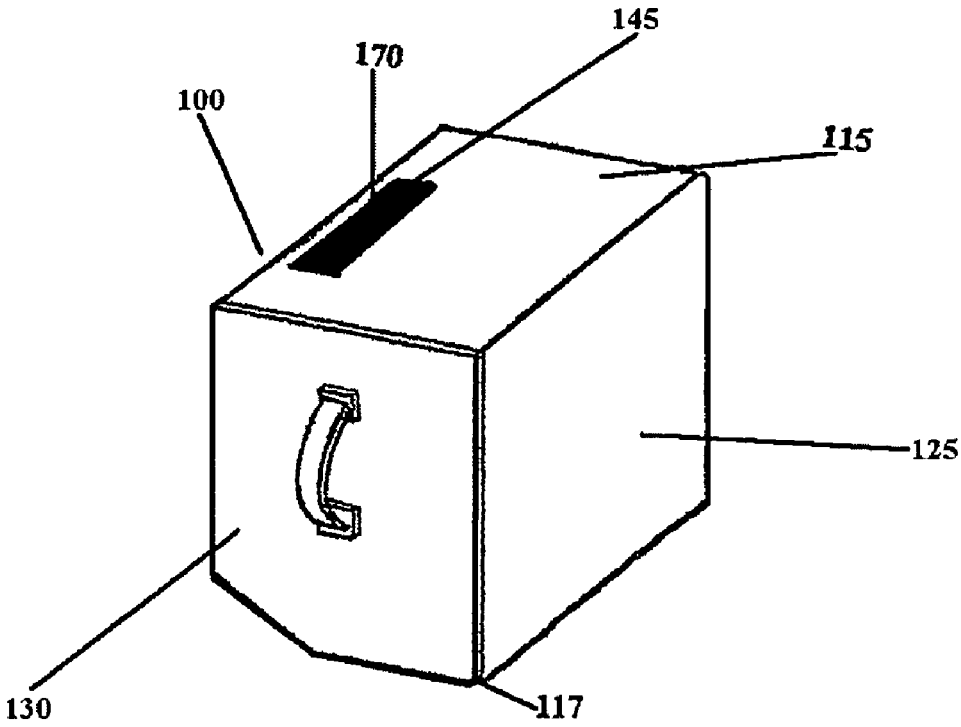
FIG. 20 illustrates a side view of the present invention having inlet means incorporated into a second upper panel overlying the second upper panel.
Figure 21:
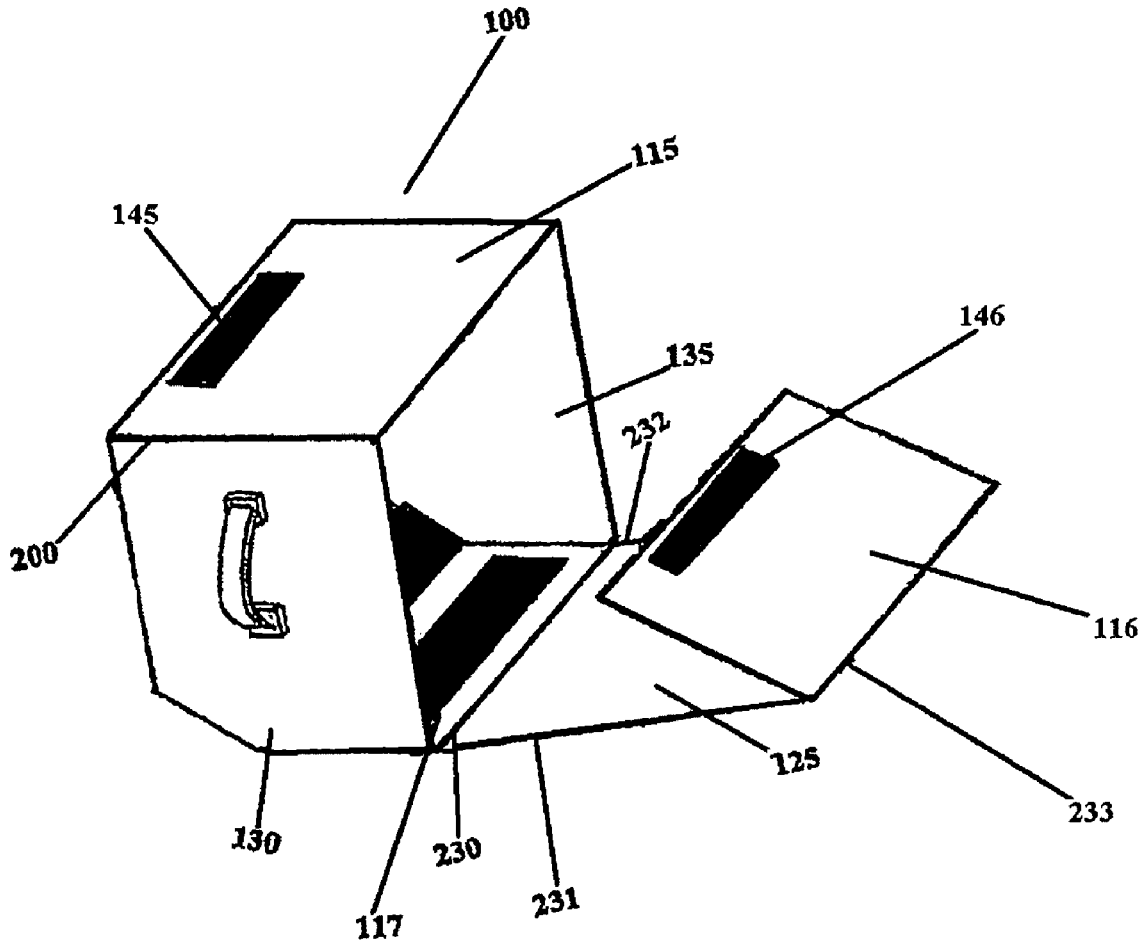
FIG. 21 illustrates a side view of the present invention having inlet means incorporated into a second upper panel overlying the first upper panel in an opened position.
Figure 22:
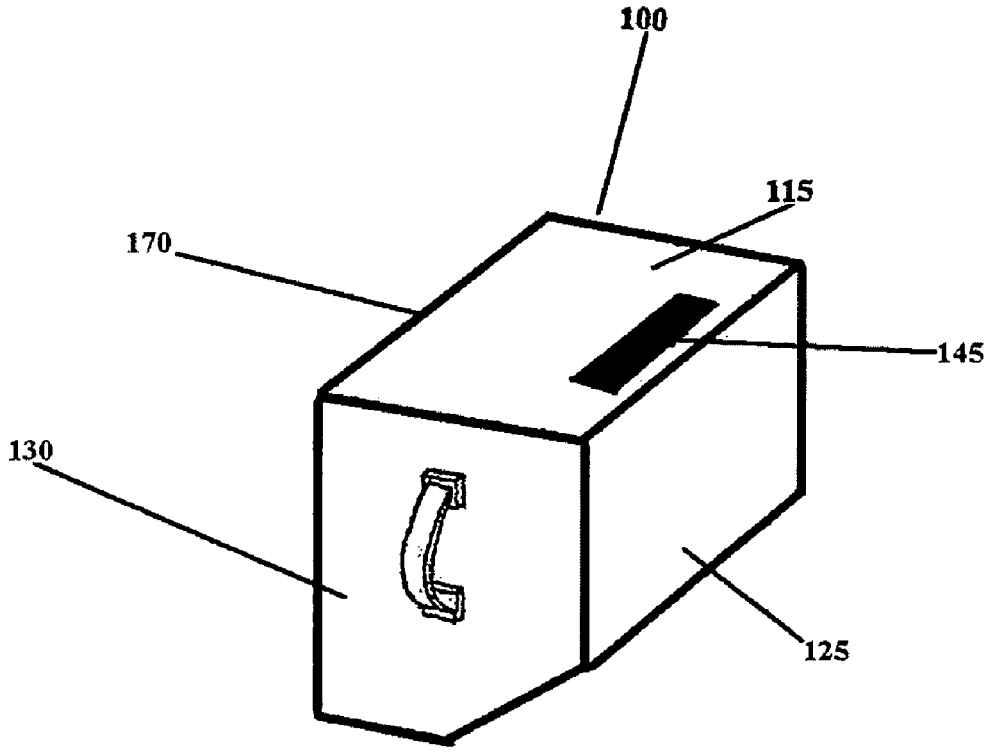
FIGS. 22 and 23 illustrates an alternative embodiment of the present invention having the inlet means incorporated into upper panels of the housing.
Figure 23:
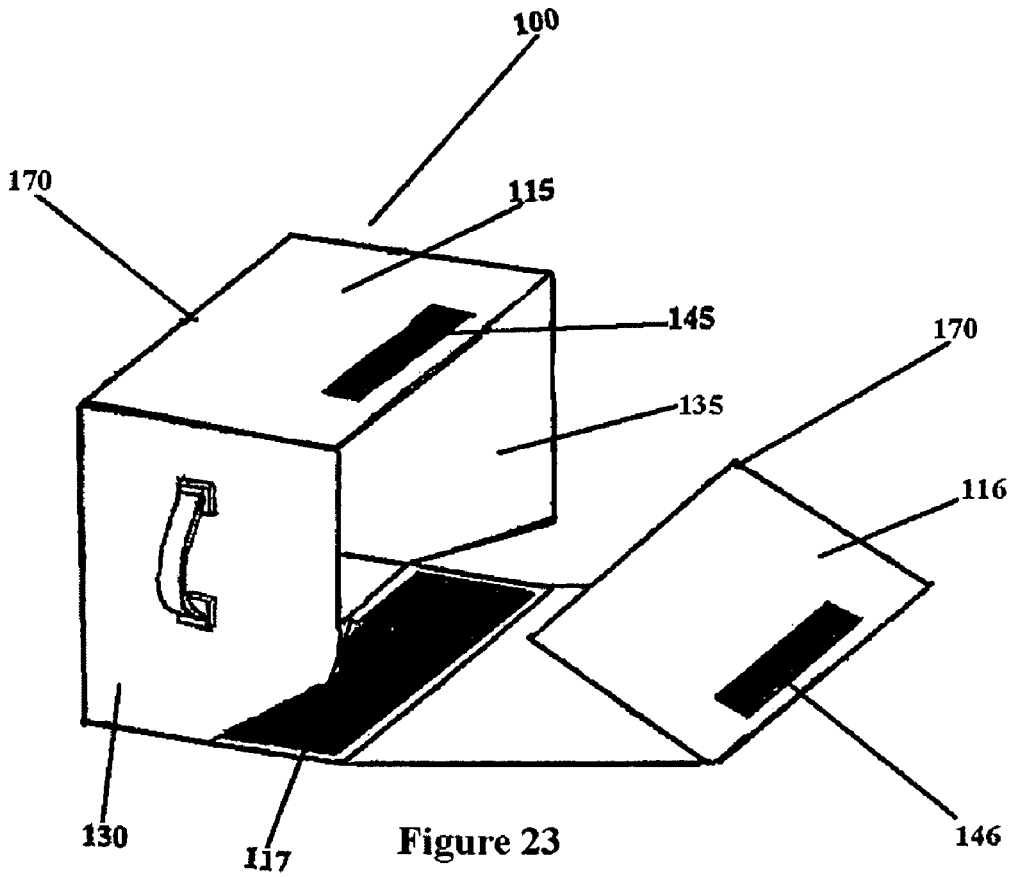

Referring to FIGS. 20 and 21, there is shown an alternative embodiment of the present invention of a protective covering for a traveling bag. In the illustrated embodiment, protective covering (100) includes a housing further defined by an upper panel (115); a lower panel (117), a front panel (120), a back panel (125), a first side panel (130), and an opposite second side panel (135). Back panel (125) is further defined by an adjoined lower edge (230), a detached first side edge (231), a detached second side edge (232), and an upper edge (233). Adjoined to upper edge (233) is a second upper panel (116). Each slot (145, 146) is dimensioned to accommodate the perimeter of the upper panel(115). As shown in FIG. 21, each upper panel (115, 116) has a slot (145, 146) which is situated within the upper panel to align over the handle of the covered traveling bag. Each slot (145, 146) is dimensioned to accommodate the handle of the traveling bag in a telescoped position when the handle is extending upward. When in a closed position, the second upper panel (116) overlays the first upper panel (115) with slot (146) overlying slot (145). The second upper panel (116) is releasably connected to the side edge (200) of first upper panel (115) using zipper means or another such compatible means. As in the illustrated embodiment, at least one opening within the lower panel (117) is made to accommodate the wheels and/or the stand of the covered traveling bag.

What is claimed is:

1. A protective covering for a traveling bag supported by a wheel and/or a stand, the protective covering comprising: a housing having substantially an equivalent shape to the traveling bag and a cavity dimensioned to encompass the traveling bag, the housing defined by a first side panel, an opposite side panel, a lower section, a back panel and upper section; a slot within the upper section aligned over a handle of the traveling bag, the slot dimensioned to accommodate the handle of the traveling bag in a telescoped position therethrough; at least one opening within the lower section dimensioned to accommodate the wheels and/or the stand of the traveling bag; and an inlet means for providing access for insertion and removal of the traveling bag into the cavity of the housing, the inlet means disposed on a section of an exterior surface of the housing; and a front section having a first cushioning means abutting a portion of an interior wall of the front section; and the first cushioning means having an equivalent shape to the front section and being removably attached to the portion the interior wall of the front section; and the first cushioning means being bounded by a top linear edge, a first side edge and an opposing second side edge.

2. The protective covering of claim 1 wherein the first cushioning means partially spans the interior wall of the front section.

3. The protective covering of claim 1 further comprising: a second cushioning means abutting and removably attached to an interior wall of the first side panel or the opposite side panel; and the second cushioning means being bounded by a top linear edge, a bottom linear edge, a first side edge and an opposing second side edge.

4. The protective covering of claim 3 further comprising a third cushioning means abutting and removably attached to an interior wall of the first side panel or the opposite side panel; and the third cushioning means being bounded by a top linear edge, a bottom linear edge, a first side edge and an opposing second side edge.

5. The protective covering of claim 3 further comprising at least one second handle fixably attached to a second predetermined location to a second section of an exterior surface of the housing.

6. The protective covering of claim 1 further comprising a flap dimensioned to cover the slot.

7. The protective covering of claim 6 wherein the flap is removably attached to a side edge of the slot.

8. The protective covering of claim 1 further comprising at least one pair of cooperative fastening straps strategically attached at a predetermine location to an interior wall within the cavity.

9. The protective covering of claim 1 further comprising at least one first handle fixably attached to a first predetermined location to a first section of an exterior surface of the housing.

10. The protective covering of claim 1 wherein at least one opening within the lower section comprises at least one first opening to accommodate the wheels supporting the traveling bag.

11. The protective covering of claim 1 wherein at least one opening within the lower section comprises at least one second opening to accommodate the stand of the traveling bag.

12. The protective covering of claim 1 wherein the inlet means further comprises: a releasable fastening means affixed horizontally across the back panel at an intermediate location dividing the back panel into an upper section and a lower section; the back panel being defined by an adjoined upper edge, an adjoined lower edge, a detached side edge and a detached opposite side edge; and when the releasable fastening means is in an opened position, the upper section can be pivoted upward along the upper edge and the lower section can be pivoted downward along the lower edge, whereby the travelling bag can be inserted into and removed from the protective covering.

13. The protective covering of claim 1 wherein the inlet means further comprises: a releasable fastening means affixed vertically across the back panel at an intermediate location dividing the back panel into an left section and a right section; the back panel being defined by an adjoined left edge, an adjoined right edge, a detached upper edge and a detached lower edge; when the releasable fastening means is in the opened position, the left section can be pivoted outward along the adjoined left edge and the right section can be pivoted outward along the adjoined right edge, whereby the covered bag can be inserted into and removed from the protective covering.

14. The protective covering of claim 1 wherein the inlet means further comprises: the back panel defined by an attached upper edge, a lower edge, a first side edge and an opposite second side edge; a releasable fastening means affixed to the lower edge, the first side edge and the opposite second side edge; and when the releasable fastening means is in an opened position, the back panel pivots upward and downward along the attached upper edge.

15. The protective covering of claim 1 wherein the inlet means further comprises: the upper section defined by an attached lower edge, upper edge, first side edge and an opposite second side edge; a releasable fastening means affixed along the upper edge, the first side edge, and the opposite second side edge; and when the releasable fastening means is in an open position, the upper panel pivots forward and backward on the attached lower edge.

16. The protective covering of claim 1 wherein the inlet means further comprises: a first side panel and a second side panel each defined by an upper edge, a lower edge, a first side edge and an attached opposite second side edge; and a releasable fastening means affixed to the upper edge, the lower edge, and the first side edge such that when the releasable fastening means is in an opened position the first the first side panel and the second side panel pivots backward and forward along the attached opposite second side edge.

17. The protective covering of claim 1 wherein the inlet means further comprises: a releasable fastening means affixed vertically across the back panel at an intermediate location dividing the back panel into an left section and a right section; the left section and the right section being defined by an adjoined left edge; an adjoined right edge, a detached upper edge and a detached lower edge; and when the releasable fastening means is in the opened position, the left section being pivoted outward along the adjoined left edge and the right section being pivoted outward along the adjoined right edge, whereby the covered bag can be inserted into and removed from the protective covering therethough.

18. The protective covering of claim 1 wherein the inlet means further comprises: a releasable fastening means affixed horizontally across the first side panel or the opposite second panel at an intermediate location dividing the first side panel or the second side panel into an upper section and a lower section defined by an adjoined upper edge, an adjoined lower edge, a detached side edge and a detached opposite side edge; when the releasable fastening means in an opened position, the upper section can be pivoted upward along adjoined upper edge and thelower section can be pivoted downward along the adjoined lower edge, whereby the covered bag can be inserted into and removed from the cavity of the protective covering.

19. A protective covering for a traveling bag supported by a wheel and/or a stand, the protective covering comprising: a housing defined by a first upper panel, a lower panel, a front panel, and a back panel; the housing having a cavity dimensioned to encompass the traveling bag; a second upper panel attached to an upper edge of the back panel and the first upper panel attached to an upper edge of the front panel; a first slot within the first upper panel proximately near its center portion, the first slot being dimensioned to accommodate a handle of the traveling bag in a telescoped position extending upward therethrough; a second slot within the second upper panel proximately near its center portion, the second slot being dimensioned to accommodate the handle of the traveling bag in a telescoped position extending upward therethrough; when in a closed position, the second upper panel overlying the first upper panel; and a cushioning means abutting and removably attached to an interior wall of a first side panel or an opposite side panel; the second upper panel being releasably connected to a side edge of the first upper panel; and at least one opening within the lower panel dimensioned to accommodate the wheels and/or the stand of the traveling bag; and the traveling bag having a stand and at least one wheel connected to an underside of the traveling bag, the stand being spaced apart from the at least one wheel at a predetermined distance; the lower panel having both a first opening and a second opening: a first opening configured to support the stand; and a second opening configured to support at least one wheel.

20. The protective covering of claim 19 further comprising a flap disposed above the slot and dimensioned to overlay the slot.

21. The protective covering of claim 19 further comprising fastening straps fixably attached at a predetermine location to a portion of an interior wall within the cavity of the housing.

* * * * *